United States Patent [19]

Brocklehurst

[11] 3,973,693

[45] Aug. 10, 1976

[54] CONTAINERS FOR CONTAINING CARBONATED BEVERAGES

[75] Inventor: Jack Brocklehurst, Leeds, England

[73] Assignee: Plastona (John Waddington) Limited, England

[22] Filed: Mar. 5, 1975

[21] Appl. No.: 555,554

[30] Foreign Application Priority Data

Mar. 12, 1974 United Kingdom ..... 10923/74
Apr. 19, 1974 United Kingdom ..... 17348/74

[52] U.S. Cl. ..... 220/66; 220/70; 229/1.5 C

[51] Int. Cl.[2] ..... B65D 1/40; B65D 21/08

[58] Field of Search ..... 220/66, 67, 70; 215/1 C; 426/106, 111, 410; 229/1.5 C

[56] References Cited

UNITED STATES PATENTS

| | | | |
|---|---|---|---|
| 2,971,671 | 2/1961 | Shakman | 220/66 |
| 3,043,461 | 7/1962 | Glassco | 215/1 C |
| 3,374,922 | 3/1968 | Shelby | 229/1.5 B X |
| 3,409,167 | 11/1968 | Blanchard | 220/66 |
| 3,426,939 | 2/1969 | Young | 220/66 |
| 3,430,805 | 3/1969 | Buchner et al. | 220/66 |
| 3,881,621 | 5/1975 | Adomaitis | 215/1 C |
| 3,904,069 | 9/1975 | Toukmanian | 220/70 X |

FOREIGN PATENTS OR APPLICATIONS

| | | | |
|---|---|---|---|
| 1,119,542 | 4/1956 | France | 220/66 |
| 1,385,421 | 12/1964 | France | 220/66 |
| 1,192,391 | 4/1959 | France | 215/1 C |

*Primary Examiner*—William Price
*Assistant Examiner*—Stephen Marcus
*Attorney, Agent, or Firm*—Wolf, Greenfield & Sacks

[57] ABSTRACT

A thin-walled nestable plastic container of the type having a tapering cylindrical wall is provided with an expansible bottom employing a central conical portion projecting upwardly into the container. The central conical portion is arranged to invert under pressure so that the cone decreases in height as it turns inside out. The base of the cone remains circular as the cone inverts and thereby provides a stable base on which the container can rest. The cone is not intended to invert completely and consequently, the apex of the cone is preferably stiffened by thickening of the wall.

3 Claims, 4 Drawing Figures

CONTAINERS FOR CONTAINING CARBONATED BEVERAGES

This invention relates to containers (referred to hereinafter and in the appended claims as "containers of the type set forth") for and containing carbonated beverages. Containers or the type set forth are of the thin walled, plastics material type presenting a gas barrier to the container contents such as to prevent substantial loss of carbonation gas over a period of storage, after the container has been sealed. The plastics material may be in laminated form so as to define an outer case and an internal liner which provides the gas barrier, the outer case providing more of the strength of the container. The container can of course be of a single thickness plastics material, but where an inner liner is provided it may be in the form of a coating on the inside of the container or it may be a separate web.

Containers of the type set forth may comprise an outer case of polystyrene, polypropylene, polyethylene or the like and the lining material may be for example, high barrier acrylic material, polyvinyl chloride or a copolymer thereof or a coating such as SARAN. There may be an intermediate layer of A.B.S. between the lining and outer case.

Containers of the type set forth have been proposed, and are used generally in packages comprising the container, a carbonated beverage, and a lid sealing the top of the container. When such a package is initially formed, the beverage is usually chilled and therefore tends to retain the carbonating gas in solution. With a rise in temperature of the beverages to ambient after sealing of the container, the pressure inside the container increases due to release of some of the carbonating gas from the beverage. The tendency is for the plastics material container to expand and such expansion is not objectionable, but of course any bursting of the container should be avoided.

It is already known that a container of the type set forth can be provided with the facility of limited expansion under an increase in gas pressure inside the container, when sealed, and a known proposal comprises providing the container with a bottom having a spherically concave region which can flex outwardly to spherically convex form when the pressure inside the container exceeds a predetermined maximum. This facility of increasing the effective volume of the container does have the advantage of relieving the internal pressure and thereby reducing the danger of the container exploding subsequently.

This invention is concerned also with arranging for a container of the type set forth to increase its volume under the action of an increase in internal pressure, but in a more advantageous way than the known arrangement.

According to the present invention there is provided a container of the type set forth wherein the container has a region of the bottom which is recessed and there is restraining ring formation surrounding the central portion of the recess so that in the event of the pressure inside the container, after it has been filled with carbonated beverage and sealed, exceeding a predetermined value, the said region is pushed outwardly by a rolling over a rolling outwards of the ring formation leaving the central portion recessed and thereby defining a base ring on which the container can be free standing.

The said recessed region preferably is a generally conical recess, with the restraining ring formation located at the base circle region of the defined cone.

The material of the container base at the apex of the conical shape preferably is thicker than the remainder of the container base so as to resist any turning inside out of the whole base under pressure.

It should be mentioned that mentioned that increasing the pressure excessively inside the container could blow out the whole base, but it will be designed for the desired functioning according to the invention based upon the normal pressures experienced and expected from the present day knowledge of canning, bottling and packaging of carbonated beverages.

The container preferably will be circular in cross-section and the recessed region will be located centrally of the container bottom.

The restraining formation can be defined by providing a ledge on a base plug to form the base of the container during its formation, which is preferably by pressure forming, in which case the container will necessarily be of thermo formable material or materials. Preferably, the said central portion is provided with re-inforcing rib formations lying transversely of the direction in which the central portion is pushed outwardly.

Such rib formation preferably are disposed radially, when the container is of circular cross section, and extend from said ring formation approximately to the centre portion.

The invention also provides a package comprising a container as aforesaid sealed by a lid and containing carbonated beverage.

An embodiment of the present invention will now be described, by way of example, with reference to the accompanying drawing, wherein.

Figure 1:
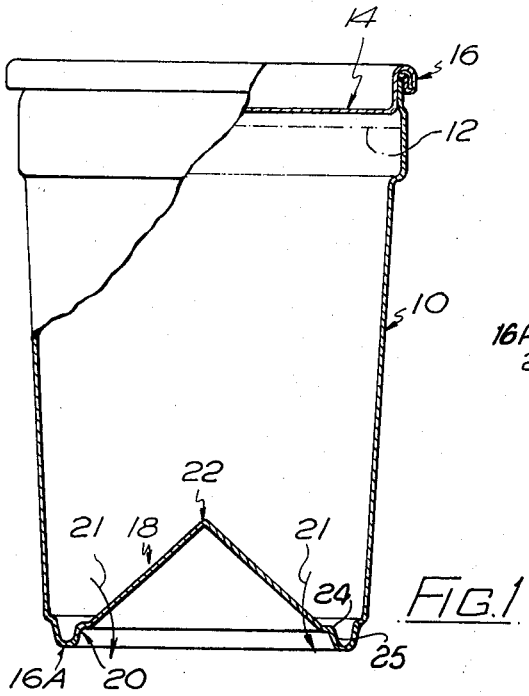
FIG. 1 is a part sectional elevation of a container of the type set forth and according to the invention when sealed with a lid and containing carbonated beverage.

Referring to the drawings, in FIG. 1 there is shown a pressure formed plastics material container 10 which has only just been filled with a carbonated beverage to level 12 and has been sealed by means of a lid 14. The lid 14 is in fact a metal cap having a "ring-pull" opening device and a flange of the metal cap 14 is crimped around the top peripheral flange of the container 10 so as to form a seal indicated by numeral 16.

The container basically is of frustro-conical shape so that similar containers can be nested one within another for transportation.

The bottom end of the container 10 is defined by ring radial base section 16A on which the empty container can stand and which is flat, a central conical recessed section 18 directed into the centre of the container and a restraining ring formation 20 which joins ring section 16 and conical section 18. Restraining ring formation 20 is in fact a right-angled shoulder recessed relative to the inner face of the conical section 18, and is located at the base of section 18. The restraining ring 20 is formed by a radial shoulder ring section 24 extending from the base of the central conical section and an axial ring section 25 joining the shoulder ring 24 to the ring section 16A. The apex of the conical section 18 is rounded. The apex portion 22 is thickened relative to the remainder of the wall of the container so as to resist turning inside out when the container is filled with carbonated beverage and sealed.

When the container 10 is filled with carbonated beverage, the beverage normally will be chilled and the cap 14 will be applied immediately. As the temperature of the beverage increases to ambient so the pressure inside the container 10 also increases. This increase in pressure is experienced on the container base and the base is gradually pushed outwards and the ring formation rolls inside out or rolls over as indicated by arrows 21 in FIG. 1, to the position shown in FIG. 2. The effect of this turning out of the base increases the effect in volume of the container 10 and thereby provides pressure relief on the other parts of the container and in particular on the seal 16. The ring formation 20 is produced to ensure that consistent with the material of the container, the quantity and type of beverage to be held by the container at the normal temperatures to be experienced by the sealed container, the base takes the configuration shown in FIG. 2.

Figure 2:
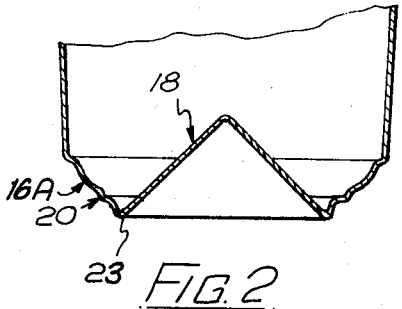
FIG. 2 is a sectional elevation of the bottom end of the container of FIG. 1 showing how it distorts under increasing pressure within the container.

Furthermore, because the apex of conical section 18 is thickened it resists inversion as does the wall region of the conical section so that indeed there is still defined in the container base when it reaches the FIG. 2 position, a ring area 23 in which the container can be free standing.

This is of considerable advantage as compared to the known arrangement which has a pop out base feature, because when the base is pushed out in the prior art arrangement, the bottom becomes spherical and of course the container ceases to be free standing.

Figure 3:
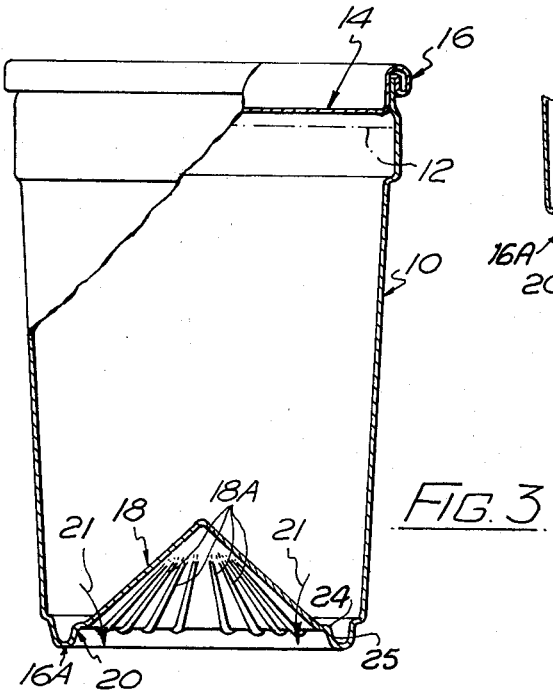
FIGS. 3 and 4 are views similar to FIGS. 1 and 2, but show another embodiment of a container according to the invention.
Figure 4:
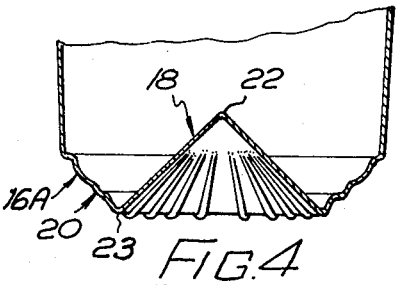

Depending upon the climates of the countries in which containers according to the invention are to be sold, so the final internal pressure may vary. Where the average level of final internal pressure is higher than say in Britain, then it may be desirable to construct the base so that there is even more resistance to complete eversion under increased internal pressure. The container shown in FIGS. 3 and 4 has a base which provides more resistance to said eversion. In FIGS. 3 and 4, the same reference numerals have been used to designate parts already described in relation to the FIGS. 1 and 2 embodiment. The container 10 shown in FIGS. 3 and 4 is in all respects identical to that shown in FIGS. 1 and 2 except that the conical recessed portion 18 is provided with reinforcing ribs 18A which merge to zero thickness at the centre of the centre portion. The presence of ribs 18A exercises a further restraint upon the tendency of the centre portion to evert beyond the ring formation 20.

I claim:

1. In a thin-walled nestable plastic container of the type having a frustro-conical wall portion, the improvement of an expansible bottom comprising a conical portion extending centrally upward into the frustro-conical portion of the container, a radial shoulder ring section connected to the bottom of the conical section and extending radially outwardly therefrom, an axial ring section attached to the radial shoulder ring section at its outer periphery and extending downwardly therefrom, a radial base ring section attached to the lower end of the axial ring section and extending outwardly therefrom, and means connecting the radial base ring section to the lower end of the frustro-conical wall portion.

2. The improvement according to claim 1, wherein the conical section is provided with ribs extending upwardly from the base of the cone toward its apex whereby the cone is stiffened by the ribs.

3. The improvement according to claim 1, wherein the wall of the upper part of the conical portion of the expansible bottom is thicker than the wall of the lower portion so as to resist eversion of the entire conical portion.

* * * * *